US008125320B2

(12) United States Patent
Yamano

(10) Patent No.: US 8,125,320 B2
(45) Date of Patent: Feb. 28, 2012

(54) FIRE ALARM SYSTEM

(75) Inventor: Naoto Yamano, Kent (GB)

(73) Assignee: Hochiki Corporation, Tokyo (JP)

( * ) Notice: Subject to any disclaimer, the term of this patent is extended or adjusted under 35 U.S.C. 154(b) by 552 days.

(21) Appl. No.: 11/914,105

(22) PCT Filed: May 10, 2005

(86) PCT No.: PCT/JP2005/008539

§ 371 (c)(1),
(2), (4) Date: Feb. 9, 2008

(87) PCT Pub. No.: WO2006/120731

PCT Pub. Date: Nov. 16, 2006

(65) Prior Publication Data

US 2009/0085727 A1 Apr. 2, 2009

(51) Int. Cl.

| | |
|---|---|
| ***G08B 3/00*** | (2006.01) |
| ***G10K 1/26*** | (2006.01) |
| ***G10K 1/38*** | (2006.01) |

(52) U.S. Cl. ..... 340/396.1; 340/384.1; 340/384.4

(58) Field of Classification Search ..... 340/384.1, 340/396.1, 384.4

See application file for complete search history.

(56) References Cited

U.S. PATENT DOCUMENTS

| | | | | |
|---|---|---|---|---|
| 3,876,999 A | | 4/1975 | Lee | |
| 3,914,616 A | | 10/1975 | Mooibroek | |
| 4,306,229 A | | 12/1981 | Tamura et al. | |
| 5,684,467 A | * | 11/1997 | Hur | 340/693.9 |
| 6,166,623 A | * | 12/2000 | Coward | 340/384.1 |
| 6,288,647 B1 | * | 9/2001 | Yamano | 340/630 |
| 6,362,726 B1 | | 3/2002 | Chapman | |
| 2009/0051508 A1 | * | 2/2009 | Yamano | 340/384.1 |

FOREIGN PATENT DOCUMENTS

| | | |
|---|---|---|
| DE | 24 50 975 | 10/1974 |
| EP | 050 98 40 A2 | 4/1992 |
| GB | 1 520 734 | 5/1974 |
| GB | 2281139 | 2/1995 |
| GB | 2 322 727 | 9/1998 |
| JP | 59-58895 | 4/1984 |
| JP | 4-28388 | 6/1992 |
| JP | 06-37992 | 5/1994 |
| JP | 3017269 | 8/1995 |
| JP | 08180272 A | 7/1996 |
| JP | 9081864 | 3/1997 |

(Continued)

OTHER PUBLICATIONS

European Patent Office, Summons to attend oral proceedings for European Patent Application No. 05739161.7 dated Dec. 29, 2009.
European Patent Office, Extended European Search Report for corresponding European Pataent Application No. 09013748.0 dated Feb. 25, 2011.

(Continued)

*Primary Examiner* — Travis Hunnings

(57) ABSTRACT

To provide a sounder that outputs a predetermined alarm to notify an abnormality in a monitored region, and includes an output device-side connection terminal on a surface facing a predetermined installation surface, to structurally and electrically connect the sounder to a base-side connection terminal provided on a predetermined fitting base fixed to the installation surface. One of the base-side connection terminal and the output device-side connection terminal is configured using plural plates disposed in approximately parallel on the installation surface, and the other is configured using a plate sandwiched by the plural plates.

15 Claims, 18 Drawing Sheets

FOREIGN PATENT DOCUMENTS

| | | | |
|---|---|---|---|
| JP | 10-241069 | | 9/1998 |
| JP | 2002-8158 | | 1/2002 |
| JP | 2003-281641 | | 3/2003 |
| JP | 2003-281641 | | 10/2003 |
| WO | WO 2004/055750 | | 7/2004 |
| WO | WO 2004055750 | A1 * | 7/2004 |

OTHER PUBLICATIONS

Japanese Patent Office, Office Action for corresponding Japanese Pataent Application No. 2009-149037 dated Jun. 15, 2011.

Two corresponding Extended European Search Reports for PCT/JP2005/008539 dated Nov. 4, 2010.

* cited by examiner

[FIG. 1]
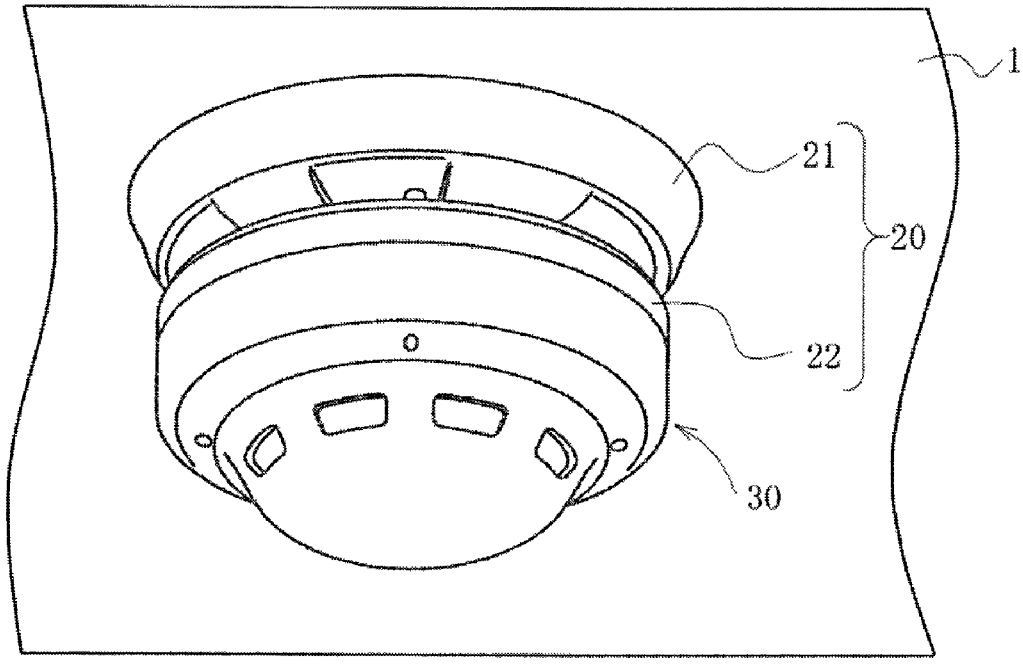

[FIG. 2]
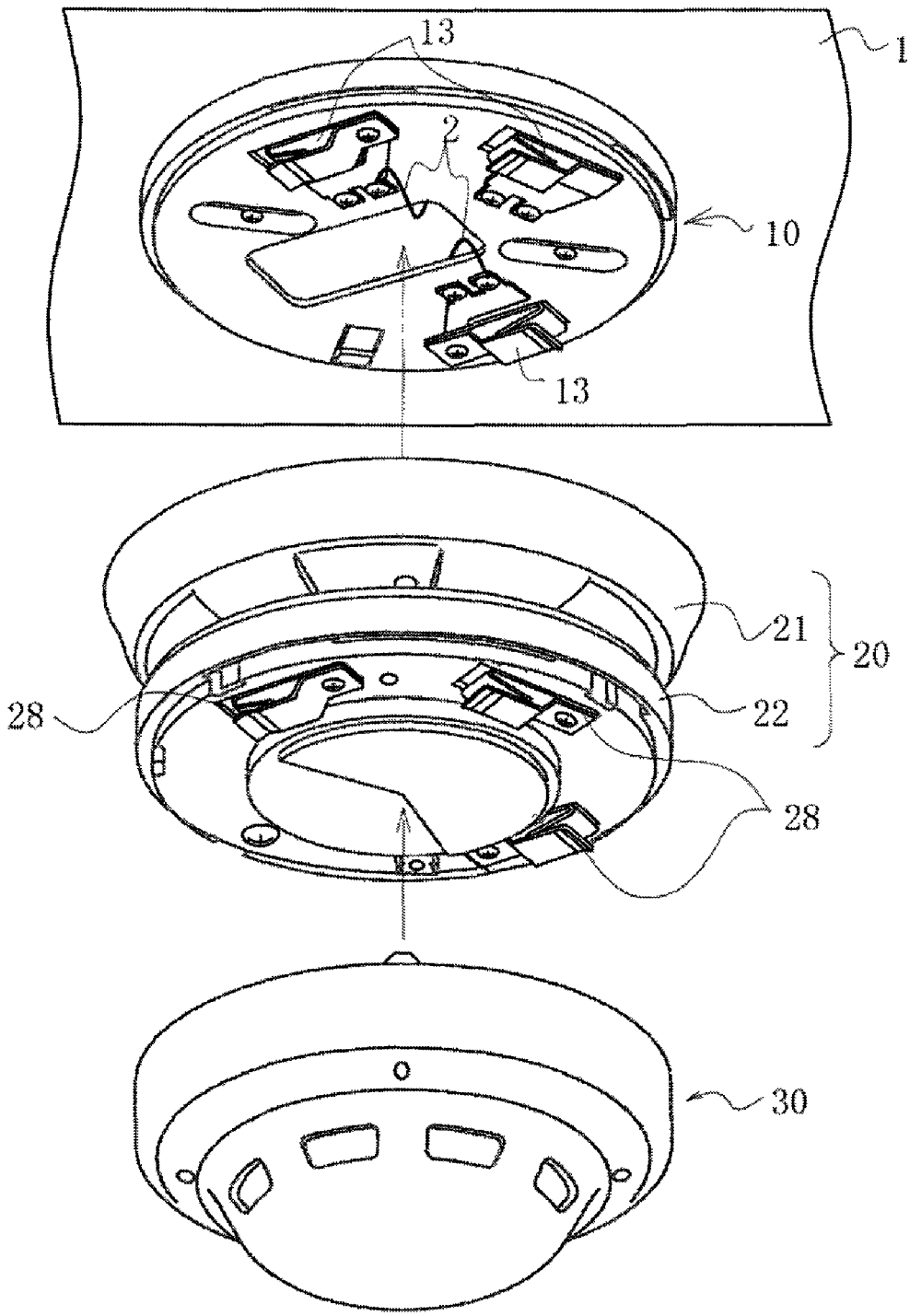

[FIG. 3]
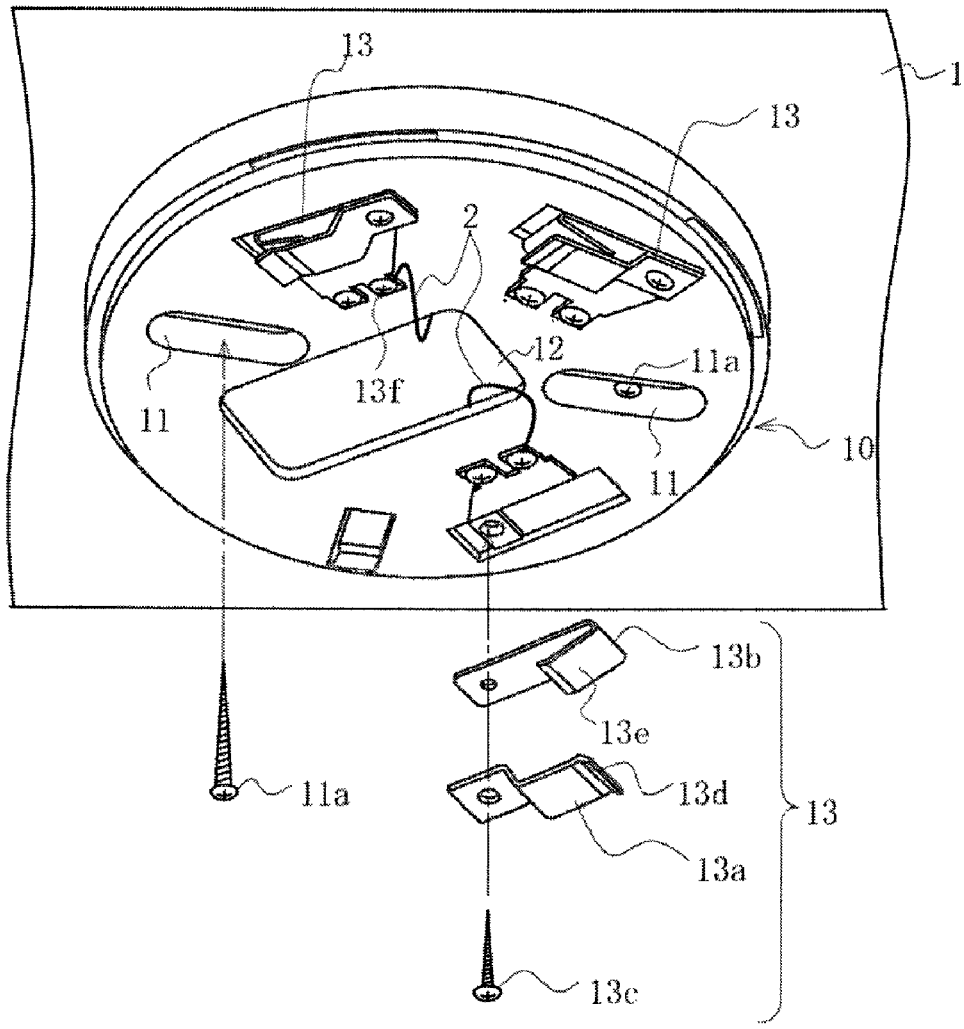

[FIG. 4]
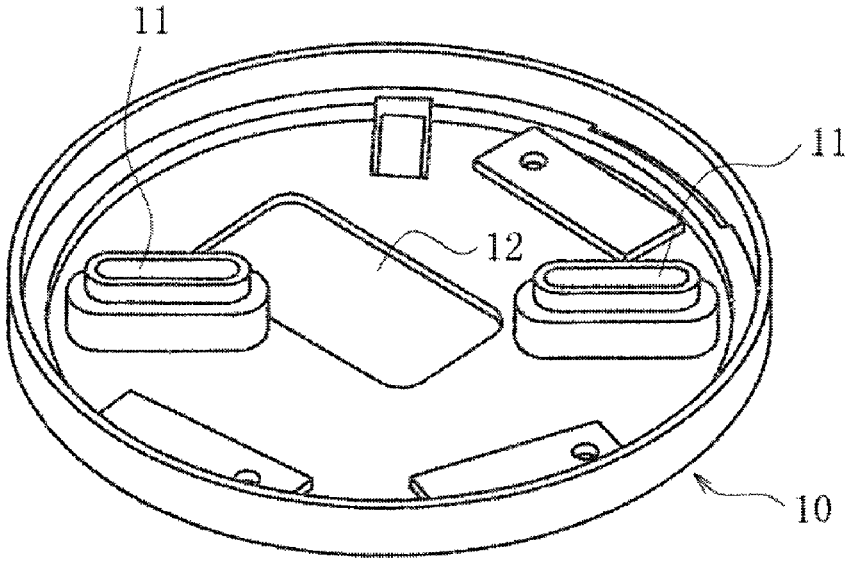
[FIG. 5]
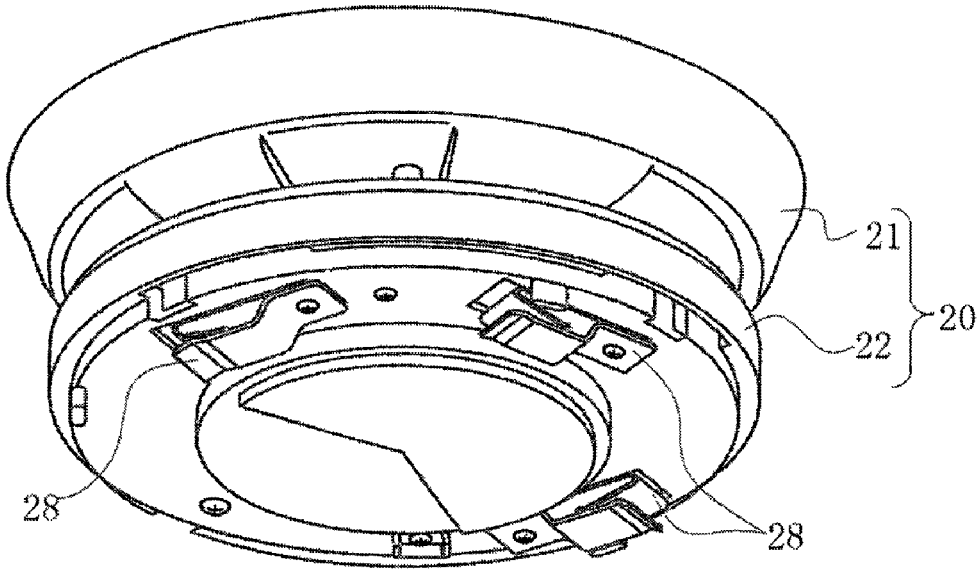

[FIG. 6]
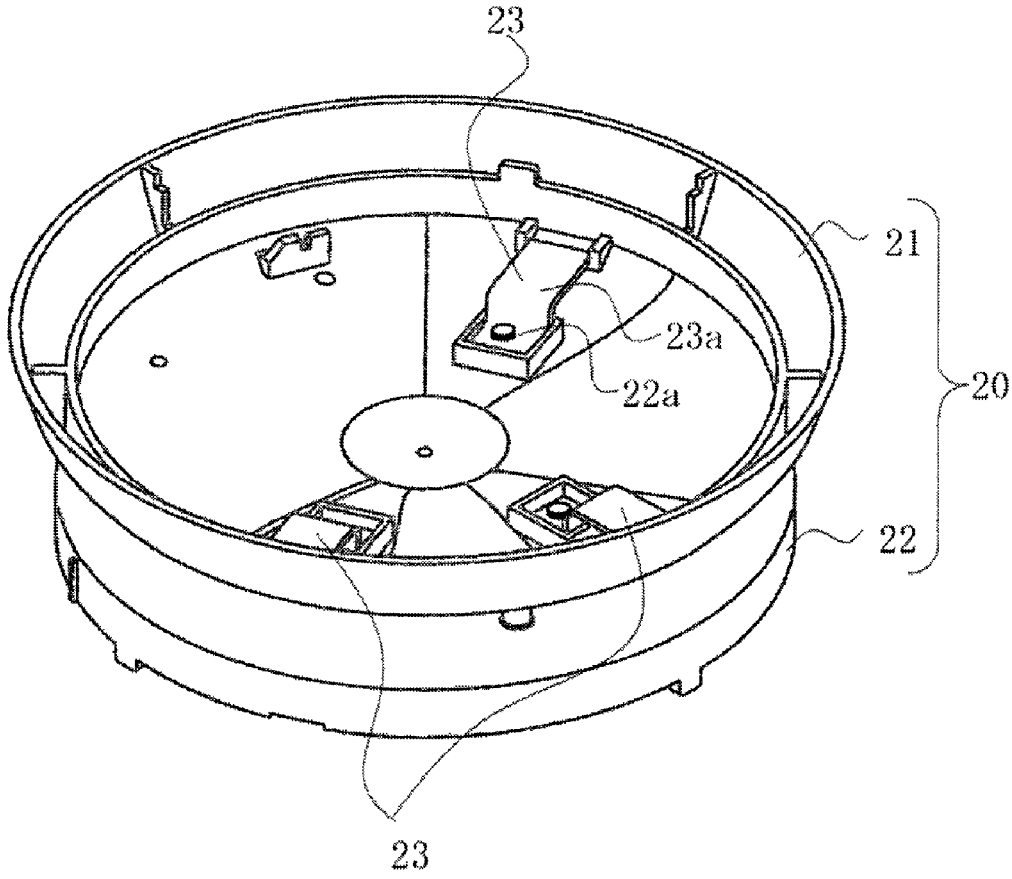

[FIG. 7]
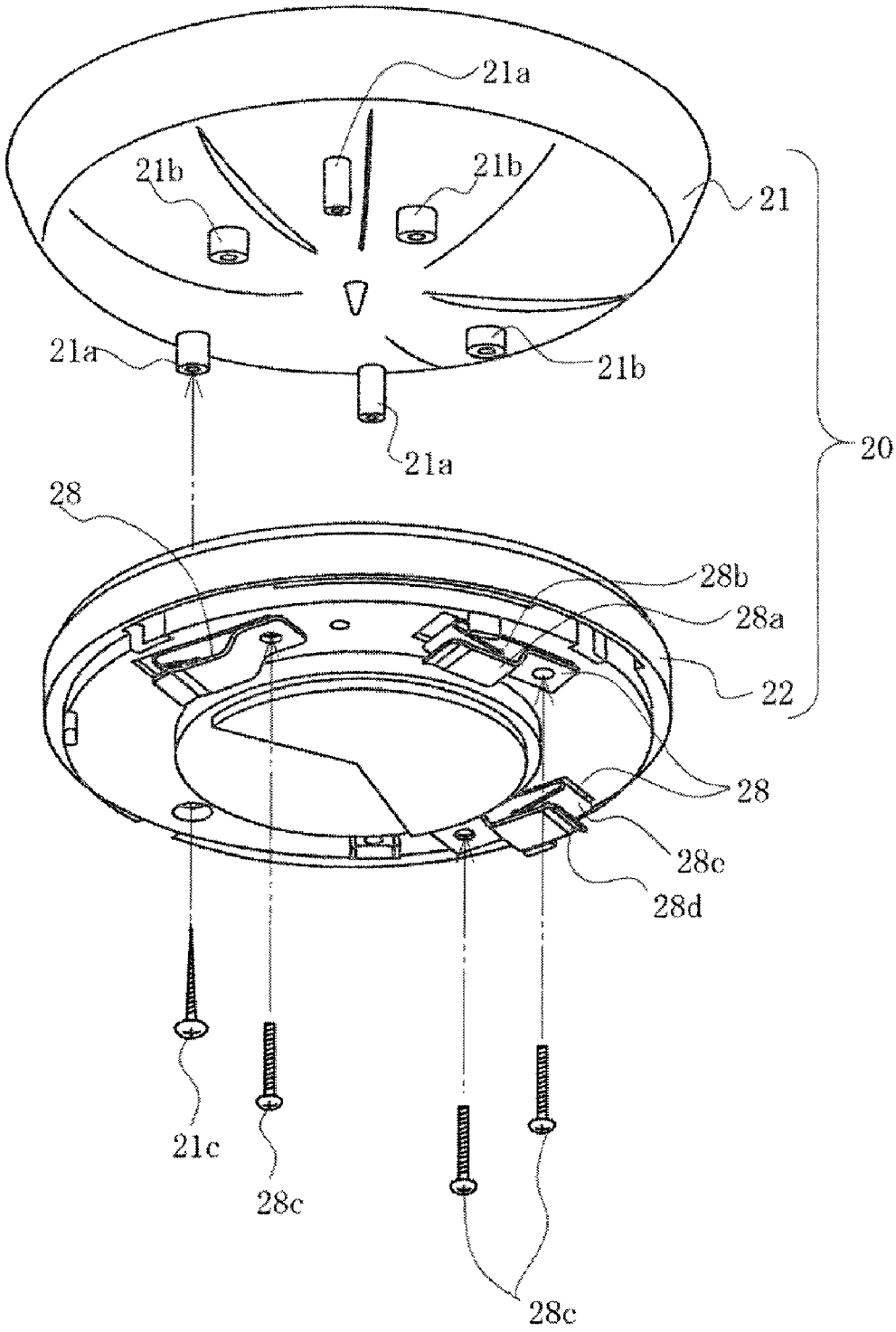

[FIG. 8]
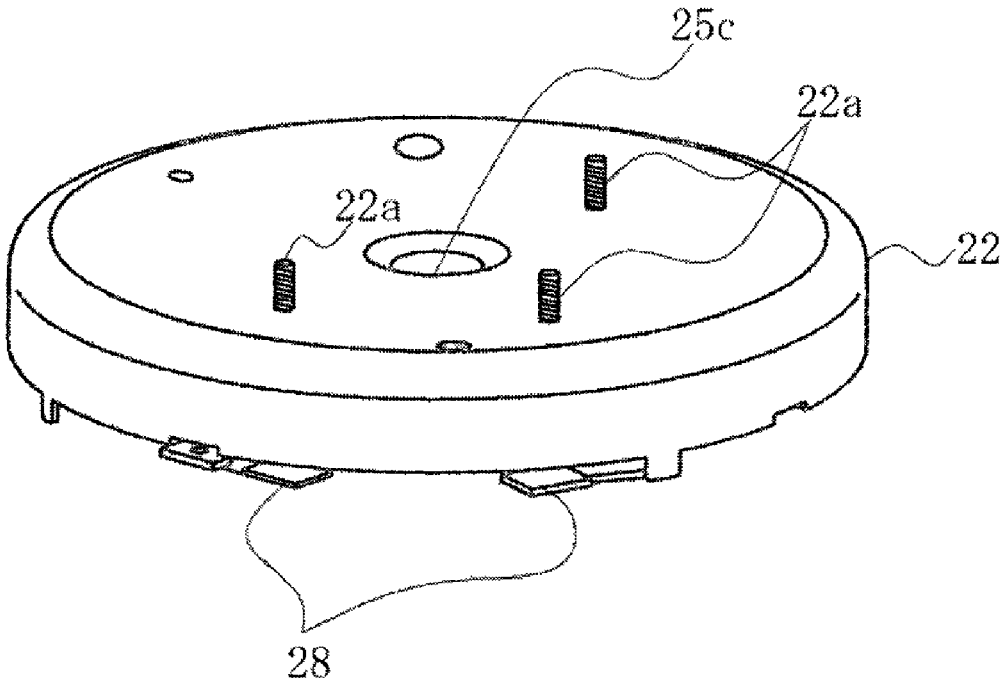

[FIG. 9]
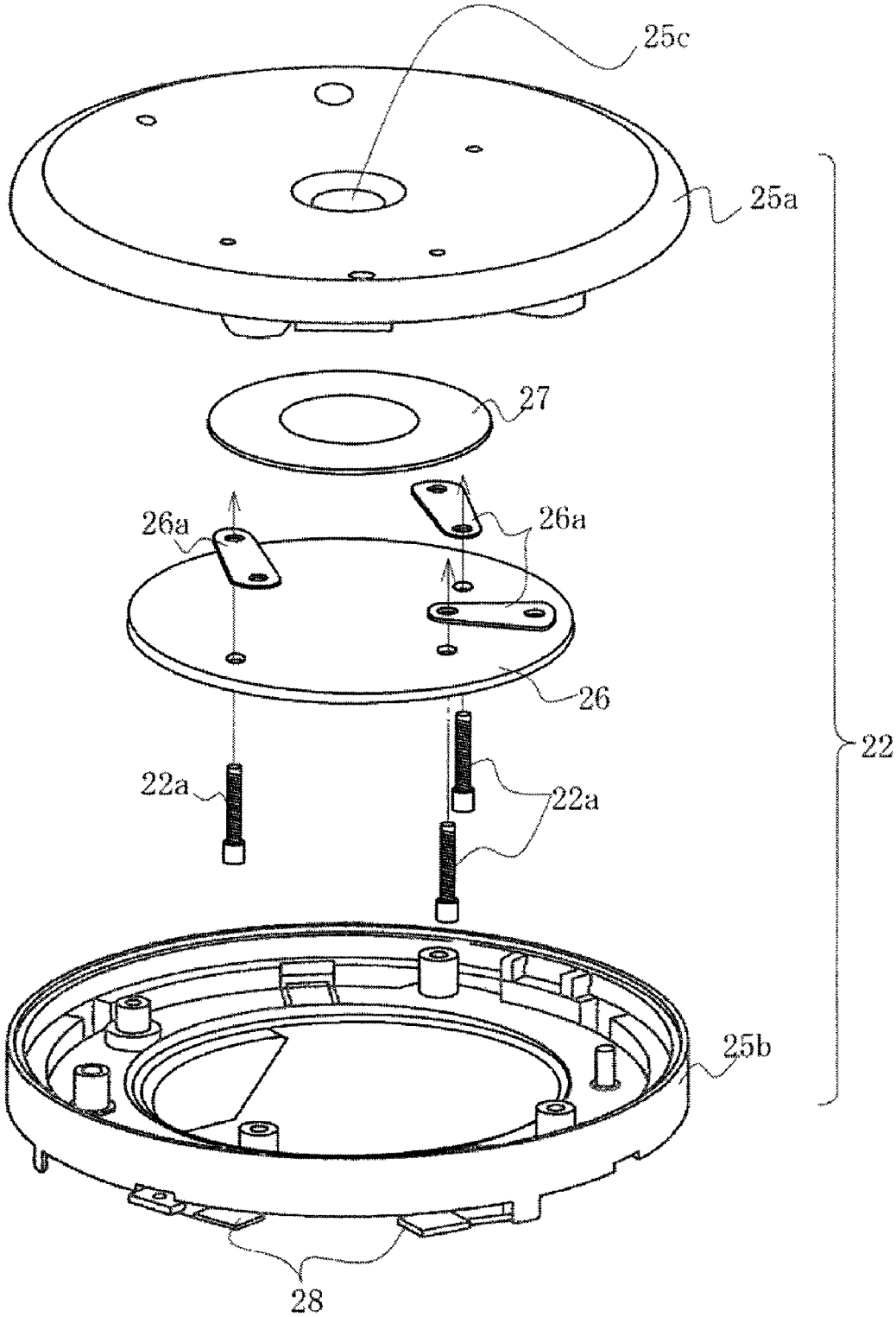

[FIG. 10]
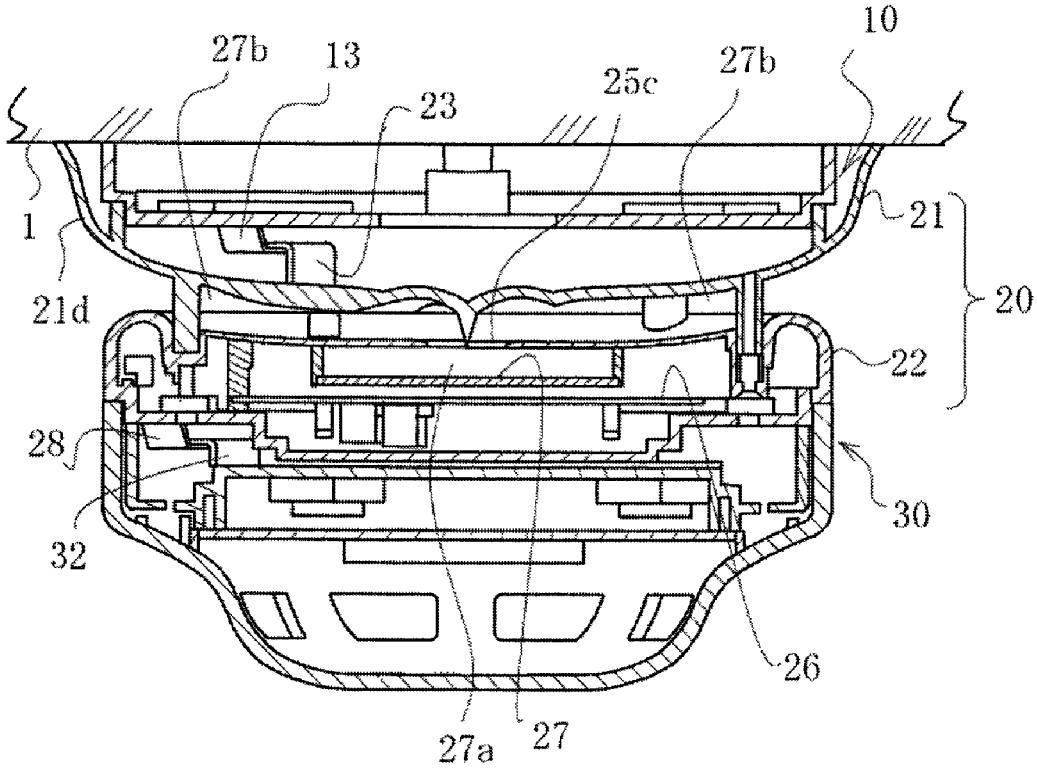

[FIG. 11]
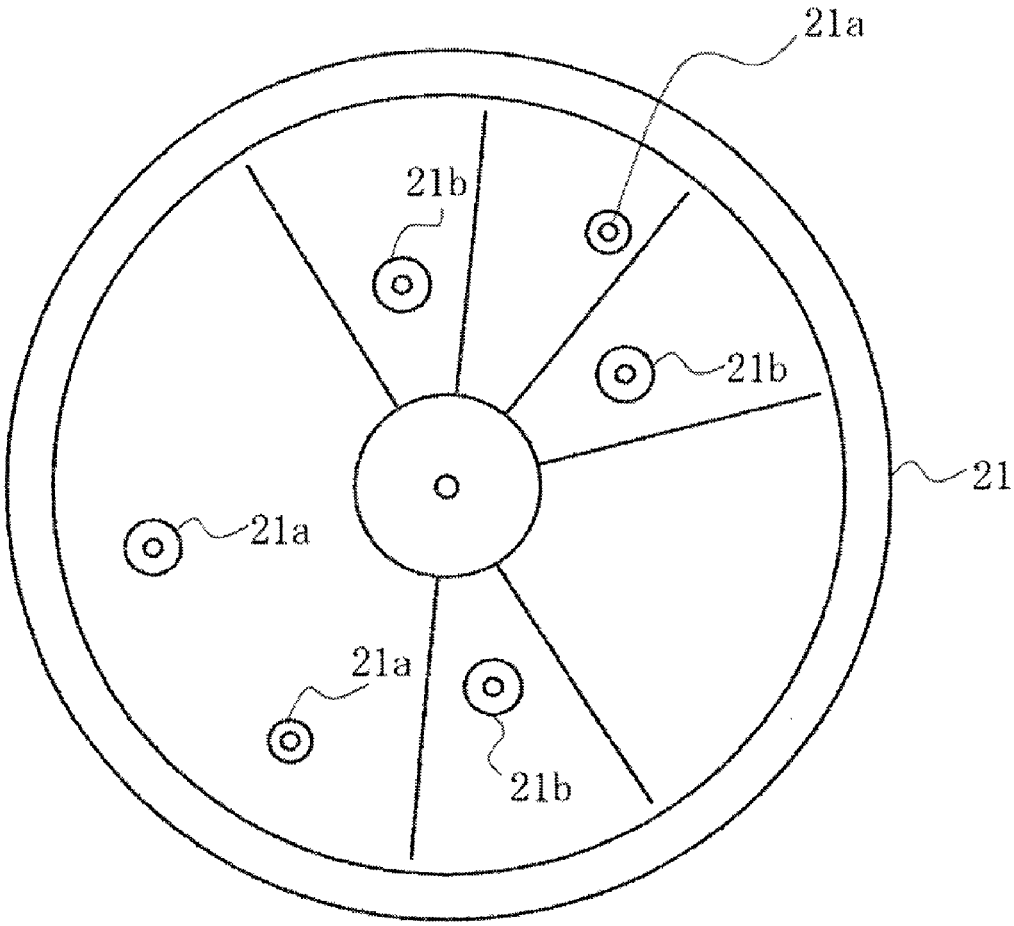

[FIG. 12]
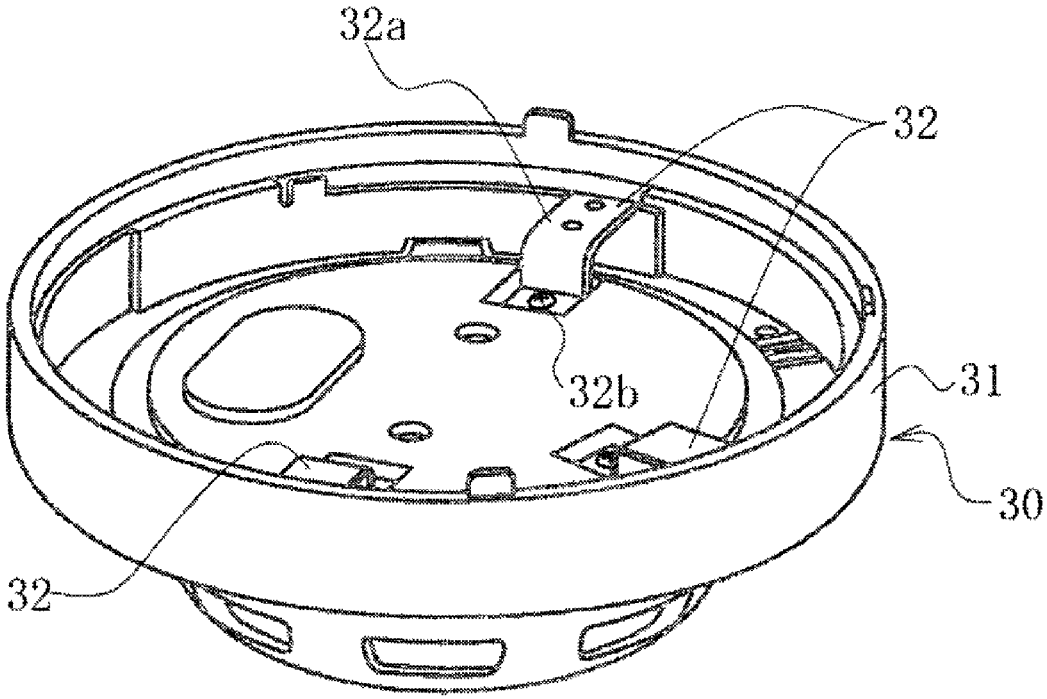

[FIG. 13]
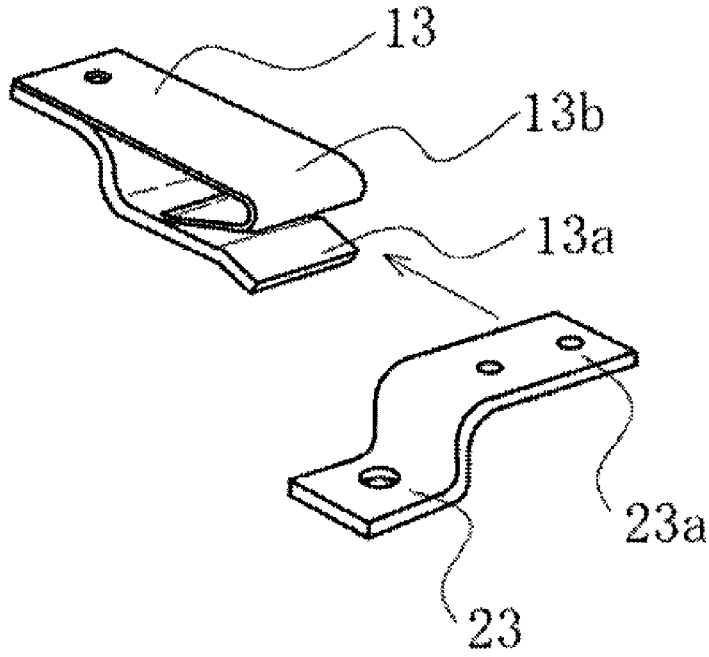
[FIG. 14]
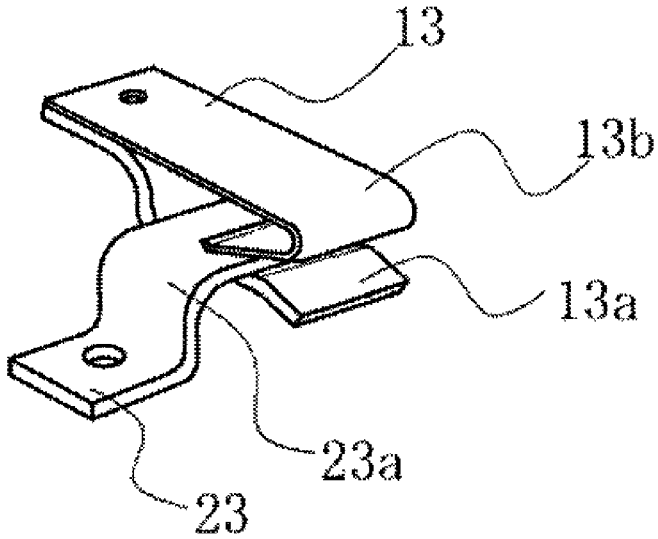

[FIG. 15]
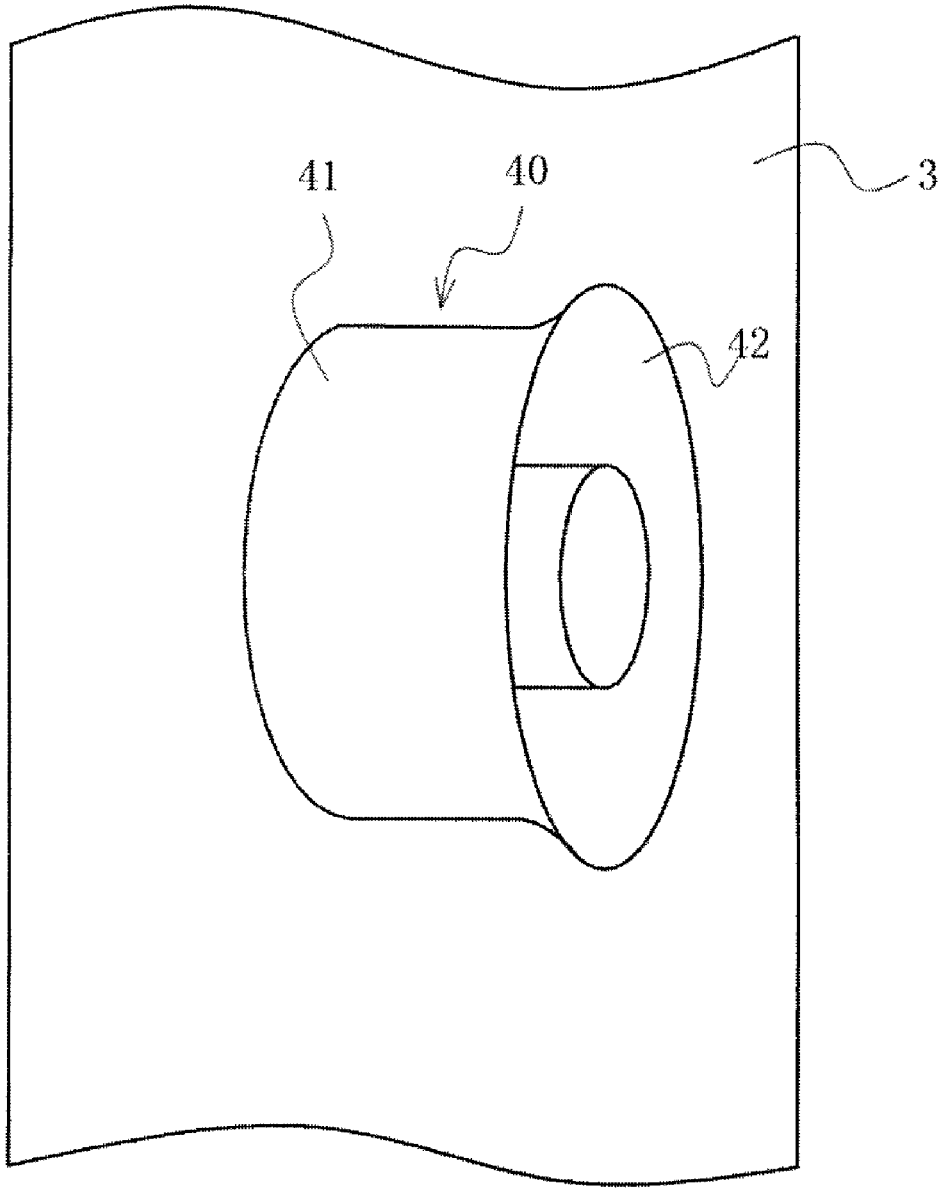

[FIG. 16]
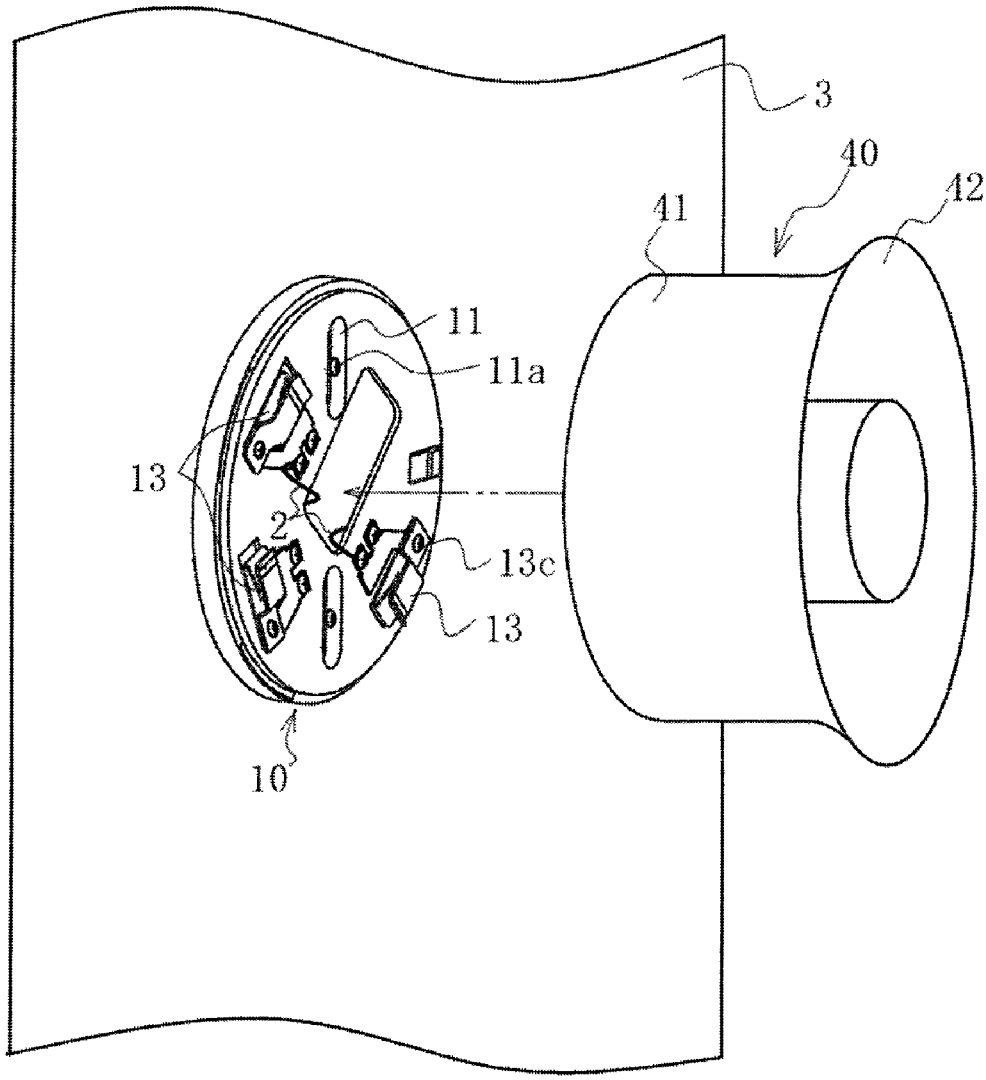

[FIG. 17]
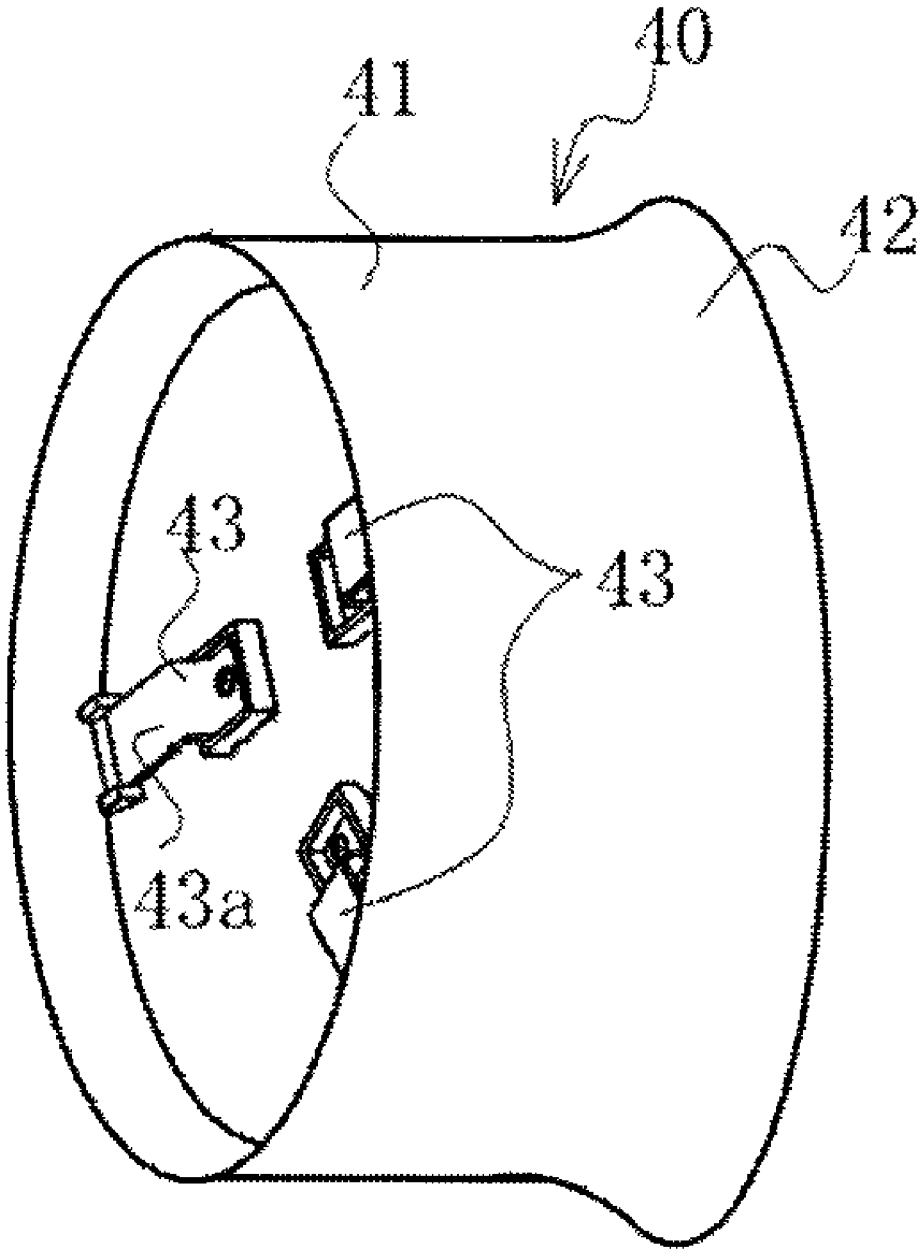

[FIG. 18]
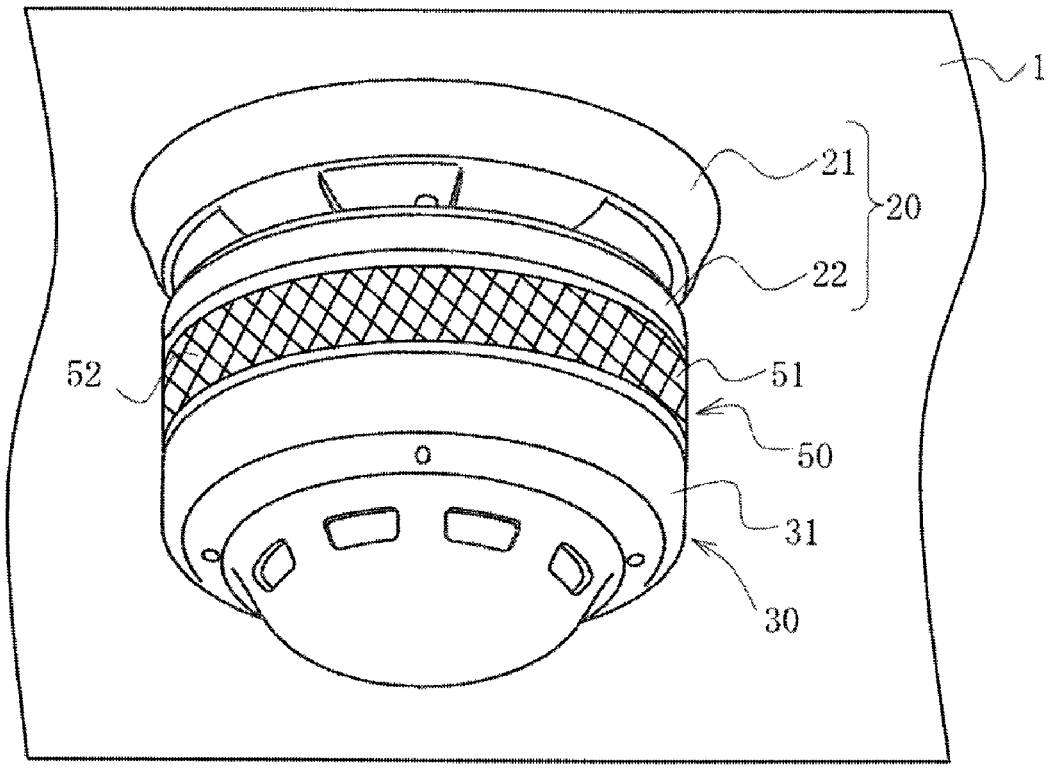

[FIG. 19]
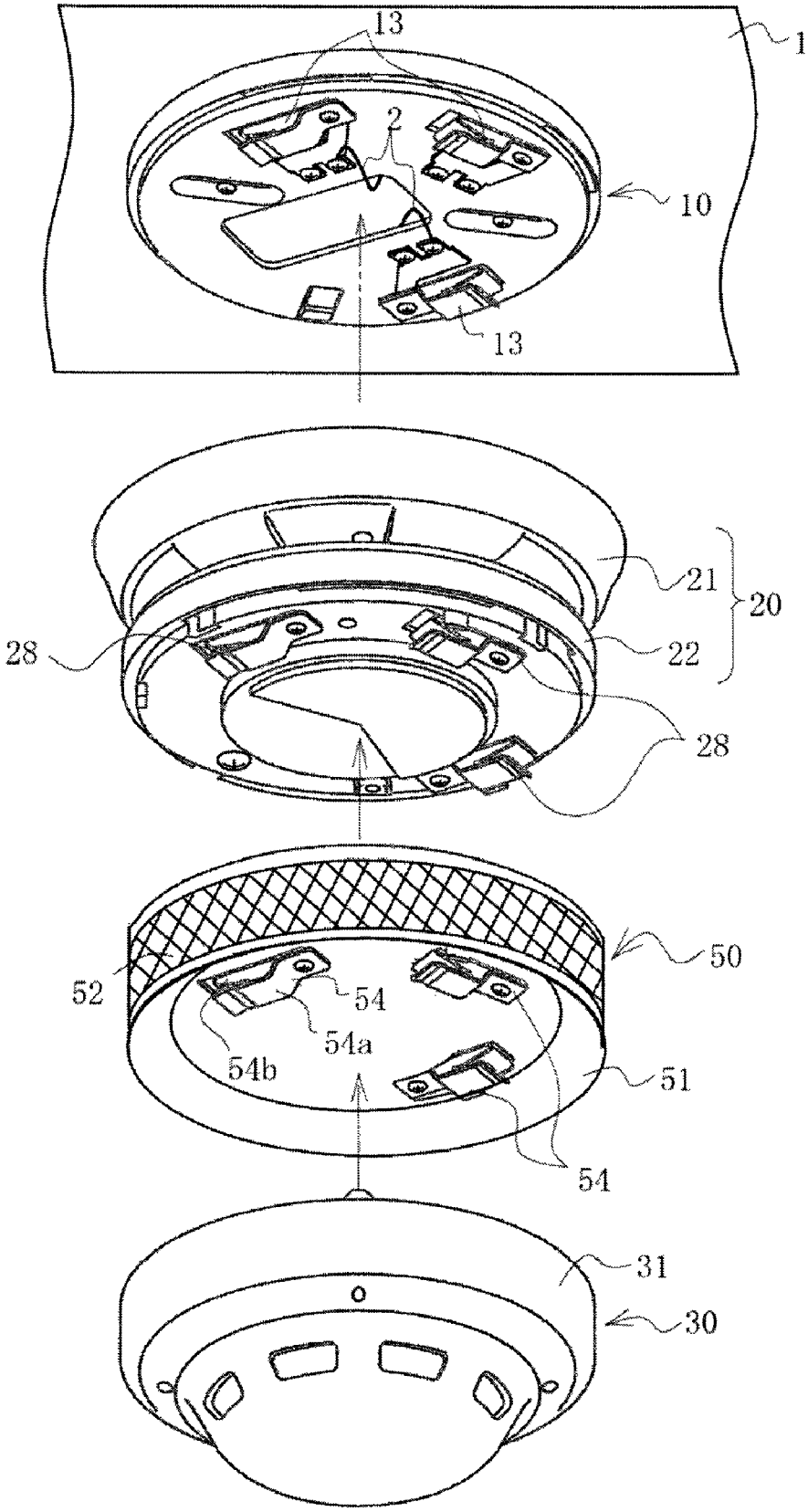

[FIG. 20]
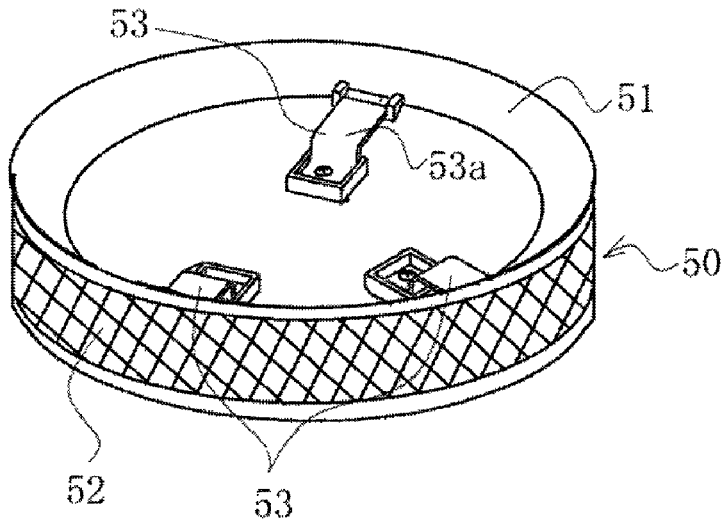
[FIG. 21]
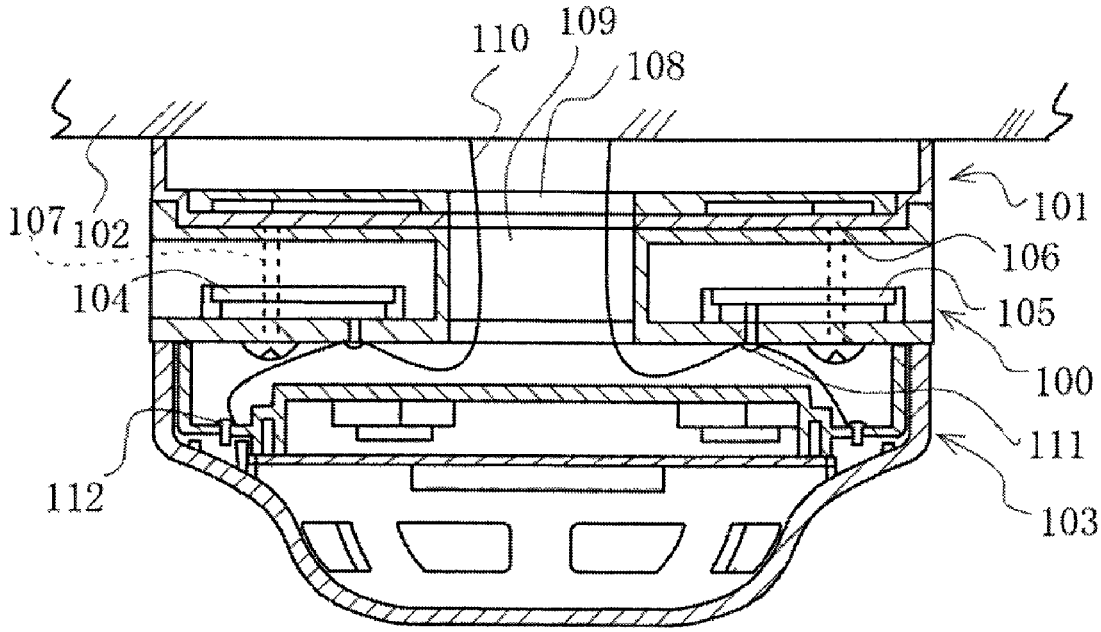

FIRE ALARM SYSTEM

TECHNICAL FIELD

The present invention relates to a sounder fitted to an alarm device that gives an alarm by detecting various kinds of abnormalities such as fires, and outputs an alarm to notify the occurrence of an abnormality, based on the output from the alarm device.

BACKGROUND ART

In order to save a building and human lives from house fire, it is effective to install a fire detector that detects the occurrence of fire at an early stage and gives an alarm. For this purpose, when the fire detector installed in a monitored region detects fire, the fire detector outputs an alarm signal to sound an alarm bell or an alarm speaker, thereby notifying the occurrence of fire.

However, in a building having high sound insulation such as a hotel, even when the alarm bell installed on an access is sounded, the alarm sound is not easily audible by users within living rooms. To solve this inconvenience, a sounder (a base sounder) that is directly fitted to the fire detector within the living room and generates alarm sound based on the output from the fire detector is put into practical use. For example, U.S. Pat. No. 6,362,726 discloses a base sounder that can be fitted to a fire alarm system. According to such base sounder, the alarm sound can be output at the same position as the fire detector within the living room, thereby more securely achieving the fire alarm.

A configuration of the above conventional base sounder is explained. FIG. 21 is a vertical cross-sectional view of the conventional sounders installed on the ceiling surface. As shown in FIG. 21, the conventional base sounder 100 is fitted to a ceiling surface 102 via a fitting base 101. A fire detector 103 is connected to a lower end of the base sounder 100. Electric constituent elements such as a circuit substrate 104 and a piezo element 105 are accommodated inside the base sounder 100. Alarm sound output from the piezo element 105 is discharged to the outside of the base sounder 100. A screw hole 106 being passed through is formed in the base sounder 100. The base sounder 100 is fixed to the fitting base 101, by having a long screw 107 inserted into this screw hole 106 and screwed into the fitting base 101. The fire detector 103 is fixed to the base sounder 100, by having an upper end of the fire detector 103 latched with the lower end of the base sounder 100.

Wiring holes 108 and 109 being passed through respectively are formed at approximately the center of the plane surface (a position near the center of the plane surface approximately horizontal with the ceiling surface 102 as the installation surface (hereinafter, "the position near the center")) of the fitting base 101 and the base sounder 100, respectively. A lead wire 110 led out from the ceiling surface 102 is drawn to reach the lower surface of the base sounder 100, via the wiring holes 108 and 109. The lead wire 110 lead out in this way is connected to a connection terminal 111 provided on the lower surface of the base sounder 100, with a screw. This connection terminal 111 is connected to a circuit substrate 104, thereby supplying power to each electric constituent element of the base sounder 100. A connection terminal 112 of the fire detector 103 is connected to the connection terminal 111, thereby supplying power to each part of the fire detector 103.

Patent Document 1: U.S. Pat. No. 6,362,726

DISCLOSURE OF THE INVENTION

Problems to be Solved By the Invention

However, the conventional sounder of the base counter has various inconveniences attributable to the fitting structure.

For example, in the conventional installation operation of the base sounder, the fitting base exclusive for the base sounder is fixed to the installation surface of the ceiling surface or the like, and the base sounder is fixed to this fitting base. On the other hand, in the case of installing only the fire detector by omitting the base sounder, a fitting base exclusive for the fire detector different from the fitting base for the base sounder is fixed to the installation surface, and the fire detector is fixed to this fitting base.

As explained above, according to the conventional practice, the fitting base for installing the base sounder to the installation surface is different from the fitting base for installing only the fire detector to the installation surface. The installation operations are different accordingly, resulting in complex installation operations, and generating operation errors. Because the installation structures are different in this way, when it is desired to further fit afterward the base sounder to the monitored region in which only the fire detector is installed, the fitting base needs to be replaced, making it difficult to fit the base sounder afterward. Further, because the base sounder is screwed into the fitting base, screws and screw-fastening tools become necessary, resulting in complex fitting operation of the base sounder.

According to the conventional base sounder, the lead wire to supply power is passed through the base sounder. Therefore, the throughhole needs to be formed at approximately the center of the plane surface of the base sunder. Because the sound source of the piezo element cannot be disposed at approximately the center of the plane surface of the base sounder, uniform acoustic output in the directions around the base sounder cannot be achieved, resulting in the difficulty of improving the alarm output.

The present invention has been achieved in view of the above conventional problems of the sounder, and has an object of providing a sounder that increases the installation operation and the alarm output efficiency, by solving the various inconveniences attributable to the fitting structure.

Effects of the Invention

According to the sounder of the present invention, the output device-side connection terminal is connected to the base-side connection terminal of the fitting base, thereby making it possible to structurally and electrically connect the sounder to the fitting base. Therefore, screws and screw-fastening tools are not necessary at the time of fitting the sounder. As a result, the fitting operation of the sounder becomes easier.

Further, according to the sounder of the present invention, the second output-side connection terminal is connected to the alarm device-side connection terminal of the alarm device, thereby making it possible to structurally and electrically connect the alarm device to the sounder. Therefore, screws and screw-fastening tools are not necessary at the time of fitting the alarm device. As a result, the fitting operation of the alarm device becomes easier.

Further, according to the sounder of the present invention, the terminals are connected to each other, by sandwiching other plate between plural plates disposed approximately in parallel on the installation surface. Therefore, even when the own weights of the sounder and the alarm device are applied to a direction orthogonal with the installation surface, the plates can support the weights, thereby making it possible to structurally and electrically connect the sounder and the alarm device.

Further, according to the sounder of the present invention, the position and the shape of the output device-side connection terminal of the sounder are set approximately the same as the position and the shape of the base-side connection terminal of the fitting base. At the same time, the position and the shape of the second output device-side connection terminal of the sounder are set approximately the same as the position and the shape of the alarm device-side connection terminal of the alarm device. Therefore, the connection structure of the sounder to the fitting base, the connection structure of the alarm device to the fitting base, and the connection structure of the alarm device to the sounder can be made common to each other. Accordingly, any one of the sounder and the alarm device can be easily fitted to the same fitting base. For example, when the sounder is going to be further fitted after only the alarm device has already been installed, the fitting operation becomes easier, without requiring the replacement of the fitting base.

BRIEF DESCRIPTION OF THE DRAWINGS

FIG. 1 is a perspective view showing a base sounder according to a first embodiment of the present invention together with a fire detector.

FIG. 2 is an exploded perspective view of the base sounder and the like shown in FIG. 1.

FIG. 3 is an enlarged perspective view of a fitting base observed from below.

FIG. 4 is an enlarged perspective view of a fitting base observed from above.

FIG. 5 is an enlarged perspective view of a base sounder observed from below.

FIG. 6 is an enlarged perspective view of a base sounder observed from above.

FIG. 7 is an exploded perspective view of the base sounder.

FIG. 8 is an enlarged perspective view of a sounder body observed from above.

FIG. 9 is an exploded perspective view of the sounder body shown in FIG. 8.

FIG. 10 is a vertical cross-sectional view of the base sounder together with the fitting base and the fire detector.

FIG. 11 is a top plan view of a base cover observed from below.

FIG. 12 is a perspective view of the fire detector observed from above.

FIG. 13 is an enlarged perspective view of a connection terminal before the connection.

FIG. 14 is an enlarged perspective view of a connection terminal after the connection.

FIG. 15 is a perspective view of a wall sounder and the like according to a second embodiment of the present invention.

FIG. 16 is an exploded perspective view of the wall sounder and the like shown in FIG. 15.

FIG. 17 is a perspective view of the wall sounder observed from the inside.

FIG. 18 is a perspective view of a base beacon and the like according to a third embodiment of the present invention.

FIG. 19 is an exploded perspective view of the base beacon and the like shown in FIG. 18.

FIG. 20 is a perspective view of the base beacon observed from above.

FIG. 21 is a vertical cross-sectional view of the conventional base sounder and the like installed on the ceiling surface.

DESCRIPTION OF REFERENCE NUMERALS

1, 102 Ceiling surface
2 Lead wire
3 Wall surface
10, 101 Fitting base
11, 106 Screw hole
11*a*, 13*c*, 21*c*, 22*a*, 28*c*, 32*b*, 107 Screw
12, 108, 109 Wiring hole
13 Base-side connection terminal
13*a*, 13*b*, 23*a*, 28*a*, 28*b*, 32*a*, 43*a*, 53*a*, 54*a*, 54*b* Plate
20, 100 Base sounder
21 Base cover
21*a*, 21*b* Interlocked pole
21*d* External edge
22 Sounder body
23, 43, 53 Output device-side connection terminal
25*a* Upper casing
25*b* Lower casing
25*c* Sound discharge opening
26, 104 Circuit substrate
26*a* Metal
27, 105 Piezo element
27*a* Resonance space
27*b* Amplifying space
28, 54 Second output device-side connection terminal
30, 103 Fire detector
31, 41, 51 Casing
32 Alarm device-side connection terminal
40 Wall sounder
42 External part
50 Base beacon
52 Clear lens
111 Connection terminal

BEST MODES FOR CARRYING OUT THE INVENTION

Embodiments of the present invention are explained below. Each embodiment relates to a sounder, and the sounder is connected to an alarm device that detects an abnormality in a monitored region. When an abnormality is detected by this alarm device, the sounder receives the input of a signal output from the alarm device, and outputs various predetermined alarm outputs.

A specific content of a region and an object monitored by the alarm device connected to the sounder is optional. For example, a fire detector that detects fire, a gas leakage detector that detects a gas leakage, and a composite fire and a gas-leakage detector that detects both fire and gas are the objects to be monitored.

A specific form of the alarm carried out by the sounder is optional, and the sounder can output alarm sound or an alarm display. In the case of outputting the alarm sound, a kind of the alarm sound and a specific sound source are also optional. For example, a speaker and a piezo element can be used to output buzzer sound, and the speaker and a sound combining unit can be used to output a sound composite message. In the case of carrying out the alarm display, a kind of the alarm display and a specific light source are also optional. For example, a flickering display and a lighting display are carried out using an LED (Light Emitting Diode) or a laser semiconductor. This sounder can be fitted to an optional installation surface, such as a ceiling surface and a wall surface.

The sounder in each embodiment has a part of a main characteristic in the fitting structure, thereby improving the fitting efficiency. Schematically, a structural and electrical connection structure between the fitting base and the sounder, between the sounder and the fire detector, and between the fitting base and fire detector, respectively are made common. Therefore, the fire detector can be fitted to the sounder in the same order to that of fitting the sounder to the fitting base. Further, the fire detector can be directly fitted to the same fitting base. By making the fitting method common, the fitting order can be also made common to the fitting of only the fire detector to the fitting base and to the sequential fitting of the sounder and the fire detector to the fitting base.

The alarm output efficiency of the sounder according to each embodiment is improved by improving the fitting structure. Schematically, the formation of the throughhole at approximately the center of the plane surface of the sounder to connect the lead wire is not necessary. Accordingly, the sound source and the light source can be disposed at the center position of the plane surface, thereby improving the alarm effect. Each embodiment having a part or the whole of this characteristic is explained in detail.

First Embodiment

First, a first embodiment of the present invention is explained. The first embodiment relates to a sounder (hereinafter, referred to as "base sounder") that is connected to a fire detector as an alarm device and outputs alarm sound based on the output from the fire detector.

A configuration of each part is explained first. FIG. 1 is a perspective view showing the base sounder according to the first embodiment together with the fire detector and the like, and FIG. 2 is an exploded perspective view of the base sounder and the like shown in FIG. 1. As shown in these drawings, a fitting base 10 is fixed to a ceiling surface 1 which is the installation surface, and a base sounder 20 is fitted to a lower part of the fitting base 10. A fire detector 30 is connected to a further lower part of the base sounder 20. In other words, the base sounder 20 is disposed to be sandwiched between the fitting base 10 and the fire detector 30. In the first embodiment, for the convenience of the explanation, a direction approaching the ceiling surface 1 from the base sounder 20 is called "above", and a direction leaving away from the ceiling surface 1 is called "below", when necessary. When a surface other than the ceiling is set as an installation surface, the "above" can be regarded as a direction of approaching the installation surface, and "down" can be regarded as a direction of leaving away from the installation surface.

FIG. 3 is an enlarged perspective view of the fitting base looked at from below, and FIG. 4 is an enlarged perspective view of the fitting base (a part of the screws and the lead wire are omitted) looked at from the above. The fitting base 10 is formed approximately in a plate shape as a whole, and includes a pair of screws 1, a wiring hole 12, and plural base-side connection terminals 13. Each screw hole 11 is a throughhole to fix to fix the fitting base 10 to the ceiling surface 1. When a screw 11*a* is inserted into the screw hole 11 and is screwed into the ceiling surface 1, the fitting base 10 can be fixed to the ceiling surface 1. This screw hole 11 is formed as a long hole. Along the longitudinal direction of the long hole, the fitting position of the fitting base 10 to the ceiling surface 1 can be easily adjusted. The wiring hole 12 is provided at approximately the center position of the plane surface of the fitting base 10. The lead wire 2 led out from the ceiling surface 1 can be inserted into the wiring hole 12, and drawn toward the base-side connection terminal 13. The end part of the core line of the lead wire 2 drawn in this way is fixed to the fitting base 10 with a screw 13*f* that is electrically connected to the base-side connection terminal 13.

The base-side connection terminal 13 is an electric connecting unit to receive power from the lead wire 2 and to input and output a signal to and from the base sounder 20 or the fire detector 30. Further, the base-side connection terminal 13 functions as a connecting unit to carry out a structural connection between the fitting base 10 and the base sounder 20 or the fire detector 30. Specifically, the base-side connection terminal 13 is configured to have two metal plates 13*a* and 13*b*, disposed in approximately parallel on the ceiling surface 1 as the installation surface (i.e., disposed to be approximately orthogonal with a detachable direction of the base sounder 20), superimposed vertically. The base-side connection terminal 13 is fixed to the lower surface of the fitting base 10 with a screw 13*c*.

A plate 23*a* of each output device-side connection terminal 23 described later of the base sounder 20 is sandwiched between the two plates 13*a* and 13*b*, thereby structurally and electrically fixing the base sounder 20 to the fitting base 10. Alternatively, by sandwiching between the two plates 13*a* and 13*b*, a plate 32*a* of an alarm device-side connection terminal 32 described later of the fire detector 30, the fire detector 30 can be structurally and electrically fixed to the fitting base 10. Particularly, an end part 13*d* of the non-fixed side of the plate 13*a* is slightly bent downward, and the other plates 23*a* and 32*a* can be smoothly inserted into between the plates 13*a* and 13*b*. An end part 13*e* of the non-fixed side of the plate 13*b* is slightly bent to allow the end part 13*e* to be inserted into between the plates 13*a* and 13*b*. Based on the elastic repulsive force of the end part 13*e*, the end part 13*e* is biased toward the plate 13*a*, thereby securely maintaining a contact between the plates 13*a* and 13*b* and the other plates 23*a* and 32*a*. A specific connection method is described later.

The base sounder 20 is explained next. FIG. 5 is an enlarged perspective view of the base sounder looked at from below, FIG. 6 is an enlarged perspective view of the base sounder looked at from the above, and FIG. 7 is an exploded perspective view of the base sounder. As shown in these drawings, in outline, the base sounder 20 is configured to include a base cover 21 and a sounder body 22.

Among of them, the base cover 21 covers approximately the whole of the fitting base 10 to improve design, dust prevention, and acoustic characteristic, by not exposing the fitting base 10 to the outside. Specifically, as shown in FIG. 6, the base cover 21 is formed in a hollow cup shape having a slightly larger diameter than that of the fitting base 10, thereby making it possible to accommodate the fitting base 10 within the base cover 21.

The output device-side connection terminals 23 are provided on the upper surface of the base cover 21. Each output device-side connection terminal 23 is an electric connecting unit to receive power from the fitting base 10 and to input and output a signal to and from the fitting base 10. The output device-side connection end 23 also functions as a connecting unit to structurally connect the base cover 20 to the fitting base 10. Specifically, the output device-side connection terminal 23 is formed with one metal plate 23*a* disposed approximately parallel with the ceiling surface 1. The plate 23*a* is disposed with a distance slightly above the upper surface of the base cover 21, and is fixed to the base cover 21 with a screw 24 at the end of the base cover 21. This plate 23*a* is sandwiched between the two plates 13*a* and 13*b* of the base-side connection terminal 13 shown in FIG. 3, thereby structurally and electrically fixing the base sounder 20 to the fitting base 10. A specific connection method is described later.

The sounder body 22 is explained next. FIG. 8 is an enlarged perspective view of the sounder body looked at from the above, FIG. 9 is an exploded perspective view of FIG. 8, and FIG. 10 is a vertical cross-sectional view showing the base sounder together with the fitting base and the fire detector. The sounder body 22 accommodates main electric structural elements of the base sounder 20, and corresponds to the output body in claims. Specifically, the sounder body 22 is formed in a hollow disk shape having a diameter approximately the same as that of the fire detector 30 shown in FIG. 1, by combining an upper casing 25*a* and a lower casing 25*b*. A circuit substrate 26 is accommodated within the sounder body 22. Electric structural elements of the base sounder 20, such as a central control unit and a power control unit (not shown), for example, are disposed on the circuit substrate 26. A piezo element 27 as a sound source of alarm sound is disposed at an upper position at approximately the center of the plane surface of the sounder body 22. The piezo element 27 is electrically connected to the circuit substrate 26. When a voltage is applied to the piezo element 27, the piezo element 27 is expanded and contracted to generate alarm sound.

Referring back to FIGS. 5 and 7, a second output device-side connection terminal 28 is provided on the lower surface of the sounder body 22. The second output device-side connection terminal 28 is an electric connecting unit to supply power to the fire detector 30 shown in FIG. 1 and to input and output a signal to and from the fire detector 30. The second output device-side connection terminal 28 also functions as a connecting unit to structurally connect the sounder body 22 to the fire detector 30. The position and the shape of the second output device-side connection terminal 28 of the sounder body 22 are approximately the same as the position and the shape of the base-side connection terminal 13 of the fitting base 10. In other words, the second output device-side connection terminal 28 is configured to have two metal plates 28*a* and 28*b*, disposed in approximately parallel on the ceiling surface 1 (not shown), superimposed vertically. The second output device-side connection terminal 28 is fixed to the lower surface of the sounder body 22 with a screw 28*c*. The plate 32*a* of the detector-side connection terminal 32 described later of the fire detector 30 is sandwiched between the two plates 28*a* and 28*b*, thereby structurally and electrically fixing the fire detector 30 to the base sounder 20. Particularly, an end part 28*d* at the non-fixed side of the plate 28*a* is slightly bent downward, and can have the plate 32*a* smoothly inserted into between the plates 28*a* and 28*b*. An end part 28*e* at the non-fixed side of the plate 28*b* is slightly bent to allow the end part 28*e* to be inserted into between the plates 28*a* and 28*b*. Based on the elastic repulsive force of the end part 28*e*, the end part 28*e* is biased toward the plate 28*a*, thereby securely maintaining a contact between the plates 28*a* and 28*b* and the plate 32*a*. A specific connection method is described later.

A mutual interlock structure between the base cover 21 and the sounder body 22 having the above configuration is explained next. FIG. 11 is a top plan view of the base cover looked at from below. As shown in FIGS. 7 to 11, plural interlocked poles 21*a* and 21*b* in a hollow cylindrical shape extending toward the sounder body 22 are integrally provided on a side surface (a lower surface) facing the sounder body 22, out of both side surfaces of the base cover 21. Out of the plural interlocked poles 21*a* and 21*b*, a part of the interlocked poles 21*a* facilitates positioning at the manufacturing time, and also functions as a hole to extract water when water drips from the back of the ceiling are pooled on the base cover and to insert a lock mechanism cancellation pin of the fitting base from the alarm device side.

The other interlocked poles 21*b* are formed at a position approximately corresponding to the plane surface position of the output device-side connection terminal 23 shown in FIG. 6 and the plane surface position of the second output device-side connection terminal 28 shown in FIG. 7. On the other hand, as shown in FIGS. 8 to 11, the sounder body 22 is provided with screws 22*a* electrically connected from the circuit substrate 26, and the screws 22*a* pierce through the upper casing 25*a* and are stretched upward. The screws 22*a* are inserted into the interlocked poles 21*b* shown in FIG. 7, and one end of each screw 22*a* is electrically connected to each output device-side connection terminal 23. The screw 28*c* electrically connects the second output device-side connection terminal 28 to a metal 26*a* extending from the circuit substrate 26. Based on this structure, the output device-side connection terminal 23, the screw 22*a*, and the second output device-side connection terminal 28 are electrically connected. By carrying out the electric connection via the interlocked poles 21*b* and the screws 22*a* in this way, the lead wire 2 shown in FIGS. 2 and 3 does not need to be inserted into the base sounder 20, and the throughhole for drawing the lead wire 2 into the base sounder 20 does not need to be formed. Therefore, degree of freedom of disposition of the piezo element 27 and other constituent elements shown in FIG. 9 can be increased.

The acoustic structure of the base sounder 20 is explained next. As shown in FIG. 10, a resonance space 27*a* is formed within the sounder body 22, and the piezo element 27 is disposed within the resonance space 27*a*. The resonance space 27*a* amplifies the alarm sound generated from the piezo element 27. The resonance space 27*a* is communicated to a sound discharge opening 25*c*. The sound discharge opening 25*c* is the opening to discharge the alarm sound output from the piezo element 27 and amplified by the resonance space 27*a*, toward an amplifying space 27*b* between the base cover 21 and the sounder body 22. The discharged alarm sound is further amplified by the amplifying space 27*b*. In other words, the cross section of the amplifying space 27*b* is formed to gradually become larger from the plane-surface center position toward the plane-surface external-side direction (in the left and right directions in FIG. 10). The alarm sound is amplified based on the horn effect. The alarm sound amplified in this way is output from the space 27*b* to the outside of the base sounder 20.

An external edge 21*d* of the base cover 21 is configured to have a gradually larger diameter toward the ceiling surface 1, and forms a smooth inclined plane to reach the ceiling surface 1. An angle of the external edge 21*d* formed with the ceiling surface 1 is determined so that the alarm sound led to the ceiling surface 1 along the external edge 21*d* is reflected from the ceiling surface 1 in high efficiency. Therefore, the alarm sound reaches the external edge 21*d* along the external side surface of the base cover 21, is smoothly led to the ceiling surface 1 along the external edge 21*d*, and is reflected to the monitored region from the ceiling surface 1 in high efficiency.

In the above structure, the throughhole to draw the lead wire 2 does not need to be formed on the base sounder 20. Therefore, the resonance space 27*a*, the piezo element 27, and the discharge sound opening 25*c* are disposed at approximately the center position of the plane surface of the base sounder 20. The amplifying space 27*b* is formed to approximately uniformly spread to the side around the approximately center position of the plane surface of the base sounder 20. Therefore, the alarm sound is amplified and spread in good balance two-dimensionally. Because the alarm sound is approximately uniformly output around the base sounder 20, the acoustic efficiency can be improved.

The fire detector 30 is explained next. The fire detector 30 can be configured approximately in the same manner as that of the conventional fire detector except a part specifically described. Explanations of the configuration approximately the same as that of the conventional fire detector will be omitted. As shown in FIG. 1, the upper part of a casing 31 of the fire detector 30 is formed in the hollow cup shape having approximately the same diameter as that of the sounder body 22 of the base sounder 20. In the state that the fire detector 30 is fixed to the base sounder 20, the side surface of the fire detector 30 and the side surface of the base sounder 20 are mutually on approximately the same plane, thereby generating a sense of unity in design.

FIG. 12 is a perspective view of the fire detector looked at from the above. As shown in FIG. 12, the alarm device-side connection terminal 32 is provided on the upper surface of the fire detector 30. The alarm device-side connection terminal 32 is an electric connecting unit that supplies power to the fire detector 30 and inputs and outputs a signal to and from the base sounder 20 or the fitting base 10. The alarm device-side connection terminal 32 also functions as a connecting unit to structurally connect the fire detector 30 to the base sounder 20 or the fitting base 10. Therefore, the position and the shape of the alarm device-side connection terminal 32 of the fire detector 30 are approximately the same as the position and the shape of the output device-side connection terminal 23 of the base cover 21 shown in FIG. 6. Specifically, the alarm device-side connection terminal 32 is formed with one metal plate 32*a* disposed approximately parallel with the ceiling surface 1 (not shown). This plate 32*a* is disposed with a slight distance from the upper surface of the fire detector 30, and is fixed to the fire detector 30 with a screw 32*b* at the end part of the fire detector 30. The plate 32*a* is sandwiched between the two plates 28*a* and 28*b* of the second output device-side connection terminal 28 of the base sounder 20 shown in FIG. 7, thereby structurally and electrically fixing the fire detector 30 to the base sounder 20. Alternatively, the plate 32*a* is sandwiched between the two plates 13*a* and 13*b* of the base-side connection terminal 13 of the fitting base 10 shown in FIG. 3, thereby structurally and electrically fixing the fire detector 30 to the fitting base 10. A specific connection procedure is described later.

A connection order of each part is explained in detail below. First, in FIG. 3, the fitting base 10 is pressed against the ceiling surface 1 from below, and the screw 11*a* is inserted into the screw hole 11 and is screwed into the ceiling surface 1, thereby fixing the fitting base 10 to the ceiling surface 1. The lead wire 2 led from the ceiling surface 1 is drawn downward through the wiring hole 12, and is fixed to the fitting base 10 with the screw 13*f*.

Next, the base sounder 20 is fitted. Because the base cover 21 and the sounder body 22 are mutually combined as a product in advance in FIG. 2, the combined base sounder 20 is pressed against the fitting base 10 from below. In this case, as shown in the enlarged perspective view of the connection terminal before the connection shown in FIG. 13, the plates 13*a* and 13*b* of the base-side connection terminal 13 of the fitting base 10 and the plate 23*a* of the output device-side connection terminal 23 of the base cover 21 are in the state approximately parallel with the ceiling surface 1, respectively, that is, in the state of mutually approximately parallel state. Therefore, when the base sounder 20 is rotated by a predetermined angle along the ceiling surface 1 as the installation surface, the plate 23*a* rotated along this rotation is inserted into and sandwiched between the plates 13*a* and 13*b*, as shown in the enlarged perspective view of the connection terminal after the connection shown in FIG. 14. In this sandwiched state, the output device-side connection terminal 23 is latched by the base-side connection terminal 13. Therefore, the output device-side connection terminal 23 is in contact with the base-side connection terminal 13 to make both conductive, and the base sounder 20 can be electrically connected to the fitting base 10. At the same time, the plates 13*a* and 13*b* and the plate 23*a* are disposed along the direction approximately in parallel with the ceiling surface 1 (approximately in the horizontal direction). As a result, the own weight of the base sounder 20 applied to the vertical direction is supported by the base-side connection terminal 13. Consequently, the base sounder 20 can be structurally supported by the fitting base 10, without using other fixing unit such as a screw. When the base sounder 20 is rotated in a direction opposite to that of fitting the base sounder 20, the base sounder 20 can be easily extracted from the fitting base 10.

Thereafter, in fitting the fire detector 30 to the base sounder 20 as shown in FIG. 2, the operation approximately the same as that of fitting the base sounder 20 to the fitting base 10 is carried out. In other words, the fire detector 30 is pressed against the base sounder 20 from below, and is rotated by a predetermined angle along the ceiling surface 1 as the installation surface. The plate 32*a* of the alarm device-side connection terminal 32 shown in FIG. 12 rotated along this rotation is then inserted into and sandwiched between the plates 28*a* and 28*b* of the second output device-side connection terminal 28 of the sounder body 22 shown in FIG. 7. In this sandwiched state, the alarm device-side connection terminal 32 is latched by the second output device-side connection terminal 28. Therefore, the alarm device-side connection terminal 32 is in contact with the second output device-side connection terminal 28 to make both conductive, and the fire detector 30 can be electrically connected to the base sounder 20. At the same time, the plates 28*a* and 28*b* and the plate 32*a* are disposed along the direction approximately in parallel with the ceiling surface 1 (approximately in the horizontal direction). As a result, the own weight of the fire detector applied to the vertical direction is supported by the second output device-side connection terminal 28. Consequently, the fire detector 30 can be structurally supported by the base sounder 20, without using other fixing unit such as a screw. When the fire detector 30 is rotated in a direction opposite to that of fitting the fire detector 30, the fire detector 30 can be easily extracted from the base sounder 20.

On the other hand, at the time of directly fitting only the fire detector 30 to the fitting base 10 by omitting the base sounder 20, the operation approximately the same as that of fitting the fire detector 30 to the base sounder 20 can be carried out. In other words, after the fitting base 10 is fitted to the ceiling surface 1, the fire detector 30 is pressed against the fitting base 10 from below, and the fire detector 30 is rotated by a predetermined angle along the ceiling surface 1. In this state, the plates 13*a* and 13*b* of the base-side connection terminal 13 of the fitting base 10 and the plate 32*a* of the alarm device-side connection terminal 32 of the fire detector 30 are mutually in a parallel state. Therefore, the plate 32*a* rotated along the rotation of the fire detector 30 are sandwiched between the two plates 13*a* and 13*b*. In this sandwiched state, the alarm device-side connection terminal 32 is latched by the base-side connection terminal 13. Therefore, the alarm device-side connection terminal 32 is in contact with the base-side connection terminal 13 to make both conductive, and the fire detector 30 can be electrically connected to the fitting base 10. At the same time, the plates 13*a* and 13*b* and the plate 32*a* are disposed along the direction approximately in parallel with the ceiling surface 1 (approximately in the horizontal direction). As a result, the own weight of the fire detector 30 applied to the vertical direction is supported by the base-side connection terminal 13. Consequently, the fire detector 30 can be structurally supported by the fitting base 10, without using other fixing unit such as a screw. When the fire detector 30 is rotated in a direction opposite to that of fitting the fire detector 30, the fire detector 30 can be easily extracted from the fitting base 10.

Alternatively, the fire detector 30 can be first fitted to the base sounder 20, and thereafter, these can be collectively fitted to the fitting base 10. Further, only the base sounder 20 can be fitted to the fitting base 10, and the fire detector 30 can be omitted. When the fire detector 30 is omitted in this way, the base sounder 20 can be first fitted to the fitting base 10, and thereafter, a cover (not shown) can be covered on the base sounder 20. With this arrangement, by covering the second output device-side connection terminal 28 and the like, safety and design can be secured. When only the fire detector 30 is already provided on the fitting base 10 at a high position, an extractor capable of holding the fire detector 30 and the base sounder 20 is fixed to the front end of a long pole. By using this extractor, the fire detector 30 is extracted, and thereafter, the base sounder 20 and the fire detector 30 can be sequentially fitted. In this way, each device can be fitted and extracted by only rotating each part, thereby facilitating the operation at a high place.

As described above, according to the first embodiment, each part can be sequentially fitted in approximately the same order. Therefore, the fitting operation can be made common. Further, regardless of presence of the base sounder 20, the same fitting base 10 can be used, thereby facilitating the fitting operation. Further, because screw cramp is not necessary to fit the base sounder 20 and the fire detector 30, screws and work tools are not necessary. As a result, the fitting operation is further facilitated.

Second Embodiment

A second embodiment is explained next. The second embodiment relates to a sounder (hereinafter, "wall sounder") that is fixed to a wall surface and outputs alarm sound based on the control of a receiving unit which receives the output from a fire detector fitted to a separate position. Configurations not particularly explained below are same as those of the first embodiment, and the configurations substantially the same as those of the first embodiment are assigned with like names or signs as those in the explanations of the first embodiment as necessary, and their explanations will be omitted.

FIG. 15 is a perspective view of a wall sounder or the like according to the second embodiment, and FIG. 16 is an exploded perspective view of the wall sounder and the like. As shown in these drawings, the fitting base 10 is fixed to a wall surface 3 as the installation surface, and a wall sounder 40 is fitted to this fitting base 10. In the second embodiment, for the convenience of the explanation, a direction approaching the wall surface 3 from the wall sounder 40 is called "inside", and a direction leaving away from the wall surface 3 is called "outside", when necessary. When a surface other than the wall surface 3 is set as an installation surface, the "inside" can be regarded as a direction of approaching the installation surface, and "outside" can be regarded as a direction of leaving away from the installation surface.

The fitting base 10 is configured in a similar manner to that of the first embodiment, and the base-side connection terminal 13 is provided on the external surface. The lead wire 2 led from the wall surface 3 is connected to the base-side connection terminal 13.

The wall sounder 40 is configured to accommodate a piezo element (not shown) as a sound source, in a casing 41 having an external diameter covering approximately the whole fitting base 10. An external part 42 of the casing 41 is formed in a shape similar to that of a loud speaker to have a larger width toward the outside. Alarm sound output from the piezo element is guided to the external part 42 via the opening (not shown), is amplified by the external part 42, and is output to the outside.

FIG. 17 is a perspective view of the wall sounder looked at from the inside. An output device-side connection terminal 43 formed at the position and in the shape similar to those of the output device-side connection terminal 23 of the base sounder 20 in the first embodiment is provided on the internal surface of the wall sounder 40. The output device-side connection terminal 43 is configured to include plates 43*a* disposed in approximately parallel on the wall surface 3 as the installation surface, in the state as shown in FIG. 17. Therefore, when the wall sounder 40 is pressed against the fitting base 10 and is rotated by a predetermined angle along the wall surface 3, each plate 43*a* rotated along this rotation is inserted into and sandwiched between the plates 13*a* and 13*b* of the base-side connection terminal 13, thereby fixing the wall sounder 40 to the fitting base 10. When the wall sounder 40 is rotated to a direction opposite to the fitting direction, the wall sounder 40 can be easily extracted from the fitting base 10.

Conventionally, a fitting base (not shown) exclusive for the wall sounder 40 is fixed to the wall surface, and the wall sounder 40 is fixed to this exclusive fitting base. Specifically, the lead wire 2 led from the wall surface 3 is passed through the exclusive fitting base and drawn, and is connected to the connection terminal provided on the internal surface of the wall sounder 40. Thereafter, a long screw is inserted into the wall sounder 40 from the outside, passed through the wall sounder 40, and is screwed into the fitting base, thereby fixing the wall sounder 40. On the other hand, according to the second embodiment, the base sounder 20 and the fire detector 30 of the first embodiment can be fitted to the fitting base 10, and the wall sounder 40 can be fitted in a similar order to that of fitting the base sounder 20 and the fire detector 30. Therefore, the fitting of the wall sounder 40 can be made common to the fitting of the base sounder 20 and the fire detector 30. The wall sounder 40, the base sounder 20, and the fire detector 30 can be easily exchanged. Because screw cramp is not necessary to fit the wall sounder 40, screws and work tools are not necessary. As a result, the fitting operation is further facilitated.

Third Embodiment

A third embodiment is explained next. In the third embodiment, a sounder is further fixed to a base sounder fixed on the ceiling surface. The third embodiment relates to the sounder (hereinafter, "base beacon") that displays an alarm based on the output from the fire detector. Configurations not particularly explained below are same as those of the first embodiment, and the configurations substantially the same as those of the first embodiment are assigned with like names or signs as those in the explanations of the first embodiment as necessary, and their explanations will be omitted.

FIG. 18 is a perspective view of the base beacon according to the third embodiment, and FIG. 19 is an exploded perspective view of the base beacon and the like shown in FIG. 18. As shown in FIGS. 18 and 19, the fitting base 10 is fixed to the ceiling surface 1 as the installation surface, and the base sounder 20 is fitted to the lower part of the fitting base 10. A base beacon 50 is fitted to the lower part of the base sounder 20. The fire detector 30 is further fitted to the lower part of the base beacon 50. The fitting base 10, the base sounder 20, and the fire detector 30 can be configured approximately in the same manner as that explained in the first embodiment, and therefore, their explanations will be omitted.

The base beacon 50 is configured to include an LED (not shown) as a light source, in a cylindrical casing 51 having an external diameter approximately the same as that of the base sounder 20. A clear lens 52 is engaged on the whole periphery of the side part of the casing 51. Light emitted from the LED is discharged to the outside via this clear lens 52.

FIG. 20 is a perspective view of the base beacon looked at from the above. As shown in FIG. 20, an output device-side connection terminal 53 is provided on the upper surface of the base beacon 50, at a similar position and in a similar shape to those of the output device-side connection terminal 23 of the base sounder 20 according to the first embodiment. This output device-side connection terminal 53 is configured to have plates 53*a*. The plates 53*a* are disposed approximately in parallel on the ceiling surface 1 as the installation surface, in a state that the base beacon 50 is disposed as shown in FIG. 19. The base beacon 50 is pressed against the base sounder 20 from below, and is rotated by a predetermined angle along the ceiling surface 1. Each plate 53*a* of the output device-side connection terminal 53 rotated along this rotation is then inserted into and sandwiched between the plates 28*a* and 28*b* of the second output device-side connection terminal 28 of the plate 53*a*, thereby fixing the base beacon 50 to the base sounder 20. In a similar order to this fitting order, the base beacon 50 can be also directly fitted to the fitting base 10, by avoiding the base sounder 20, like in the case of the fire detector 30 in the first embodiment. When the base beacon 50 is rotated in the direction opposite to that of fitting the base beacon 50, the base beacon 50 can be easily extracted from the base sounder 20.

As shown in FIG. 19, on the lower surface of the base beacon 50, second output device-side connection terminals 54 are provided at a position and in a shape similar to those of the second output device-side connection terminals 28 of the base sounder 20 in the first embodiment. Each second output device-side connection terminal 54 is configured by combining two plates 54*a* and 54*b*. The plates 54*a* and 54*b* are disposed approximately in parallel on the ceiling surface 1 as the installation surface, in a state that the base beacon 50 is disposed as shown in FIG. 19. The fire detector 30 is pressed against the base beacon 20 from below, and is rotated by a predetermined angle along the ceiling surface 1. Each plate 32*a* of the alarm device-side connection terminal 32 (not shown) rotated along this rotation is then inserted into and sandwiched between the plates 54*a* and 54*b* of the second output device-side connection terminal 54, thereby electrically and structurally fixing the fire detector 30 to the base beacon 50. When the fire detector 30 is rotated in the direction opposite to that of fitting the fire detector 30, the fire detector can be easily extracted from the base beacon 50.

Conventionally, the base beacon 50 is fitted to the fitting base 10 common to the fire detector 30, in a shape similar to that of the fire detector 30. Therefore, the base beacon 50 cannot be installed coaxially with the fire detector 30. However, in the third embodiment, based on the employment of the connection structure similar to that of the base sounder 20 in the first embodiment, the fire detector 30 can be also connected to the lower surface of the base beacon 50. According to the above third embodiment, the base sounder 20 and the fire detector 30 of the first embodiment can be fitted to the fitting base 10. In a similar fitting order, the base beacon 50 can be also fitted to the fitting base 10 and the base sounder 20. Therefore, the fitting of the base beacon 50 can be made common to the fitting of the base sounder 20 and the fire detector 30. The base beacon 50, the base sounder 20, and the fire detector 30 can be easily exchanged with each other. Further, because the fitting of the base beacon 50 does not require screw cramp, screws and work tools are not necessary, thereby further facilitating the fitting operation.

While each embodiment of the present invention has been described above, modifications and variations of specific configurations and methods of the present invention can be optionally made within the technical scope of the invention described in the claims. Such a modified example is explained below.

The configuration of each embodiment can be also applied to other embodiments. For example, in the first and the third embodiments, the fire detector 30 is disposed at the lowest part to increase the fire detection capacity. In order to maximize the alarm output effect, the fire detector 30 can be fixed to the fitting base 10. The base sounder 20 and the base beacon 50 can be fixed to the lower part of the fire detector 30. In this case, the second output device-side connection terminal 28 can be provided on the lower surface of the fire detector 30. When the connection terminals shown in each embodiment are provided on the upper surface and the lower surface of various detectors having the heat and gas detecting functions, for example, these detectors can be combined according to need, and the terminal device having the composite function can be configured.

The connection terminals can take various positions and shapes other than those described in each embodiment. For example, one of the mutually connected connection terminals can be set as a male terminal used to connect the plug of household electric appliances, and the other connection terminal can be used as a female terminal that detachably receives the male terminal. In each embodiment, each part can be structurally and electrically connected using a connection terminal. However, it can be arranged such that the structural connection is carried out by fastening with screws like the conventional practice, and only the electric connection is carried out in the connection structure according to the configurations of the present invention.

The problems to be solved by the present invention and the effects of the present invention are not limited to the above-described content. The present invention can also solve problems not described above, and can have effects not described above. The present invention also solves only a part of the described problems, and has only a part of the effects described above. For example, even when the connection structure of each part cannot be made completely common, the object of the present invention can be achieved so long as when the connection efficiency is slightly improved from the conventional efficiency.

The structure examples, and size relationships, positional relationships, and thicknesses of the parts described in the above document and drawings are simply illustrative, and these can be optionally changed unless otherwise specified.

INDUSTRIAL APPLICABILITY

As described above, the sounder according to the present invention can be used to give alarm based on the output from the alarm device. Particularly, the sounder according to the present invention is useful to improve the operation of fitting the sounder to the installation surface and the output efficiency of alarm from the sounder.

The invention claimed is:

1. A fire alarm system comprising:

a fitting base that is fixed to an installation surface;

an alarm device directly attachable to the fitting base and that detects an abnormality in a monitored region; and a sounder directly attachable to the fitting base and that outputs an alarm to notify the abnormality in the monitored region and is attached to the alarm device, wherein one of the alarm device and the sounder is directly attached to the fitting base.

2. A fire alarm system comprising:

a fitting base that is fixed to an installation surface;

an alarm device directly attachable to the fitting base and that detects an abnormality in a monitored region; and a plurality of sounders attachable to each other and that output an alarm to notify the abnormality in the monitored region and are attached to the alarm device, wherein each of the plurality of sounders is directly attachable to the fitting base, wherein one of the alarm device and the plurality of sounders is directly attached to the fitting base.

3. A fire alarm system comprising:

a fitting base that is fixed to an installation surface; and at least two devices including:

an alarm device that detects an abnormality in a monitored region, and at least one sounders attachable to the alarm device and that outputs an alarm to notify the abnormality in the monitored region, wherein each of the at least two devices is attachable to each other and attachable to the fitting base.

4. The fire alarm system according to claim 1, wherein, a connection structure between the fitting base and the alarm device, a connection structure between the fitting base and the sounder, and a connection structure between the alarm device and the sounder are the same type.

5. The fire alarm system according to claim 2, wherein, a connection structure between the fitting base and the alarm device, a connection structure between the fitting base and the sounder, and a connection structure between the alarm device and the sounder are the same type.

6. The fire alarm system according to claim 3, wherein, a connection structure between the fitting base and the alarm device, a connection structure between the fitting base and the sounder, and a connection structure between the alarm device and the sounder are the same type.

7. The fire alarm system according to claim 2, wherein, a connection structure between the fitting base and the alarm device, a connection structure between the fitting base and the sounder, a connection structure between the alarm device and the sounder, and a connection structure between the plurality of sounders are the same type.

8. The fire alarm system according to claim 3, wherein, a connection structure between the fitting base and the alarm device, a connection structure between the fitting base and the sounder, a connection structure between the alarm device and the sounder, and a connection structure between the plurality of sounders are the same type.

9. The fire alarm system according to claim 1, wherein, the sounder is a base sounder having a sound source that outputs the alarm.

10. The fire alarm system according to claim 1, wherein, the sounder is a base beacon having a light source.

11. The fire alarm system according to claim 2, wherein, at least one of the plurality of sounders is a base sounder having a sound source that outputs the alarm, and the other of the plurality of sounders is a base beacon having a light source.

12. The fire alarm system according to claim 3, wherein, at least one of the plurality of sounders is a base sounder having a sound source that outputs the alarm, and the other of the plurality of sounders is a base beacon having a light source.

13. The fire alarm system according to claim 1, comprising, a wall sounder that outputs an alarm to notify the abnormality in the monitored region, wherein, the wall sounder can be directly fixed to the fitting base.

14. The fire alarm system according to claim 13, wherein, a connection structure between the fitting base and the alarm device, a connection structure between the fitting base and the sounder, a connection structure between the alarm device and the sounder, and a connection structure between the fitting base and the wall sounder are the same type.

15. The fire alarm system according to claim 1, comprising, a cover that covers a part or whole of the sounder, wherein, the cover can be fixed to the sounder that is fixed to the fitting base.

* * * * *